United States Patent [19]

Soma et al.

[11] Patent Number: 4,643,366

[45] Date of Patent: Feb. 17, 1987

[54] ROLLER MILL

[75] Inventors: Hiroshi Soma, Kobe; Isao Hashimoto, Akashi; Tosuke Kinoshita; Masahiro Uchida, both of Kobe; Susumu Uchiyama, Nishinomiya, all of Japan

[73] Assignee: Kawasaki Jukogyo Kabushiki Kaisha, Kobe, Japan

[21] Appl. No.: 753,235

[22] Filed: Jul. 9, 1985

[51] Int. Cl.[4] ..... B02C 15/00

[52] U.S. Cl. ..... 241/117

[58] Field of Search ..... 241/117-121

[56] References Cited

U.S. PATENT DOCUMENTS

| | | | |
|---|---|---|---|
| 2,684,813 | 7/1954 | Loesche . | |
| 4,349,158 | 9/1982 | Broman . | |
| 4,382,561 | 5/1983 | Andersen et al. | 241/121 |

FOREIGN PATENT DOCUMENTS

| | | |
|---|---|---|
| 1179211 | 5/1959 | France . |
| 89375 | 6/1967 | France . |
| 2565849 | 12/1985 | France . |
| 12148 | 6/1983 | Japan . |
| 12151 | 6/1983 | Japan . |
| 60-00302 | 1/1985 | Japan . |

*Primary Examiner*—Mark Rosenbaum

*Attorney, Agent, or Firm*—Marshall, O'Toole, Gerstein, Murray & Bicknell

[57] ABSTRACT

A roller mill according to this invention includes a table adapted to be rotatably driven on a substantially vertical axis. The table is adapted to receive the material to be milled in a central area around the axis. The table has a substantially horizontal upper surface, and an annular groove is formed in the upper surface radially outwardly from the central area. The groove has a curved bottom surface. A least one roller is provided having an axis of rotation which is above the upper surface of the table and substantially intersects the table axis. The roller extends into and rolls in the groove and has an outer peripheral surface which is curved in cross section. The mill when in use has the table and the roller rotated, and the material extends into a clearance space formed between the peripheral surface of the roller and the bottom surface of the groove. The table has an annular overhang on the upper surface thereof adjacent the outer periphery of the groove to throttle the movement of the material out of the clearance space.

8 Claims, 6 Drawing Figures

ROLLER MILL

FIELD AND BACKGROUND OF THE INVENTION

The present invention relates to a vertical roller mill for crushing or milling clinkers or blast furnace slag for use as cement material.

FIG. 1 of the accompanying drawings shows a prior art vertical roller mill, of the type disclosed in Japanese Patent Provisional Publication No. 60-12151 laid open on Jan. 22, 1985. In FIG. 1, the mill includes a rotary table 2 having an annular groove 4 formed in its upper surface 3. The table is rotated on a substantially vertical axis, and the groove 4 is located adjacent the outer periphery 5 of the table. A plurality of circumferentially spaced rollers 6 (only one shown) are supported above the table and roll in the groove 4. Material 9 being milled is located in a clearance space 8 formed between the groove 4 and the rollers. The width of the space 8 is narrowed on the radially outward side of the groove to resist the outward flow therefrom of the material 9 being milled, in order to produce efficient milling etc.

It is a general object of this invention to provide a vertical roller mill, which is improved in its capability to retain material being milled in the groove between the rotary table and the rollers for a relatively long time.

BRIEF SUMMARY OF THE INVENTION

A roller mill according to this invention includes a table adapted to be rotatably driven on a substantially vertical axis. The table is adapted to receive the material to be milled in a central area around the axis. The table has a substantially horizontal upper surface, and an annular groove is formed in the upper surface radially outwardly from the central area. The groove has a curved bottom surface. At least one roller has an axis of rotation, which is above the upper surface of the table and substantially intersects the table axis. The roller extends into the groove and has an outer peripheral surface which is curved in cross section. The mill when in use has the table and the roller rotated, and the material extends into a clearance space formed between the peripheral surface of the roller and the bottom surface of the groove. The table has an annular overhang in the upper surface adjacent the outer periphery of the groove to throttle the clearance space and restrain the material from leaving the groove.

BRIEF DESCRIPTION OF THE DRAWINGS

The invention will be better understood from the following description and,the accompanying drawings, wherein.

DETAILED DESCRIPTION OF THE EMBODIMENTS

Figure 1:
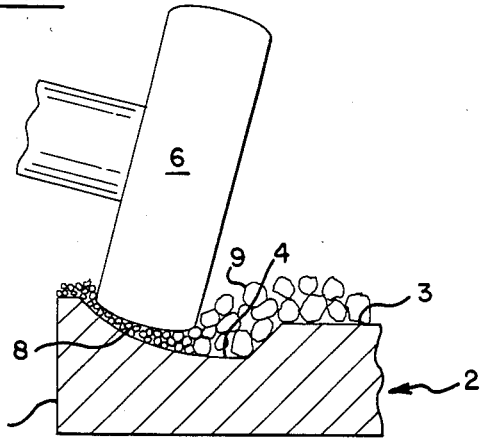
FIG. 1 PRIOR ART
FIG. 1 is a fragmentary side view partially in axial cross section of a conventional roller mill.

In the drawings, corresponding parts are given similar reference numerals.

Figure 2:
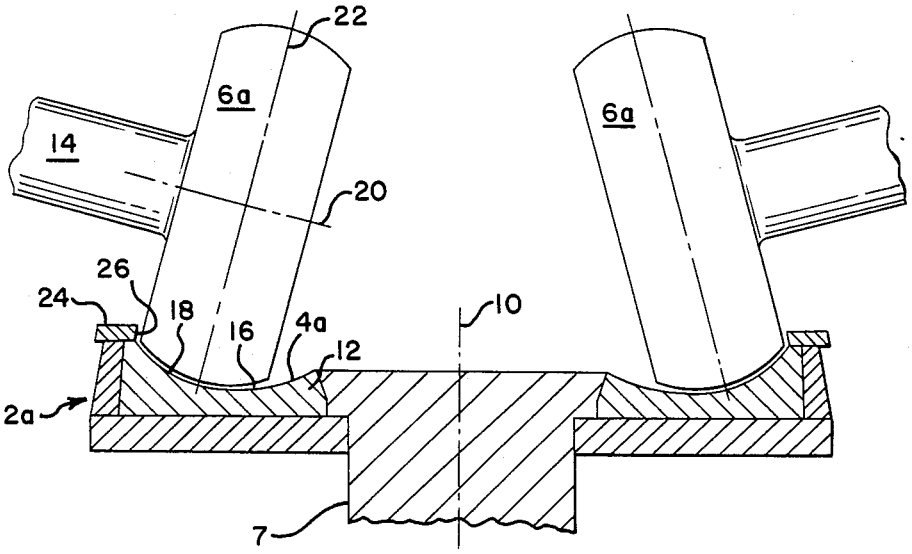
FIGS. 2–5 are fragmentary side views partially in axial cross section of roller mills in accordance with first, second, third and fourth embodiments of the invention.

With reference to the first embodiment shown in FIG. 2, the vertical roller mill includes a rotary table **2*a* made of a wear resistant metal, which is supported on a base 7 and during operation is rotatably driven on a vertical axis 10. The table 2*a* preferably has an annular liner 12 secured to its upper surface adjacent the outer periphery. The liner 12 has an annular groove 4*a* formed in its upper surface. The groove 4*a* has a generally circular bottom when viewed in a cross sectional plane that includes the table axis 10 as shown in FIG. 2**.

Material (not shown in FIG. 2) to be milled is fed to the center area of the table **2*a* around the axis 10, and it moves radially outwardly by centrifugal action, and the material enters the groove 4*a***.

A plurality of rollers **6*a* are provided above the table 2*a*. Each roller 6*a* is journalled on the end of a support arm 14, that is supported at its outer end on the frame (not shown) of the mill so that the arm 14 may pivot in a vertical plane that includes the table axis 10, but the arm is prevented from moving out of this plane. The roller 6*a* has an outer peripheral surface 8 which is circular when viewed in a cross sectional plane including the rotational axis 20** of the roller.

Each roller **6*a* and the associated arm 14 swing downwardly by gravity and conventional force or compression means (not shown) acting on the arm 14, and the roller 6*a* rides on the top of the material as the material moves radially outwardly through a narrow clearance space 16 between the roller peripheral surface 18 and the bottom of the groove 4*a***. The material is thereby compressed and crushed or milled between the roller and the groove.

On the side of the clearance space 16 which is radially inward of the table **2*a* from a plane 22 that extends radially of the roller 6*a* and is located axially centrally of the roller 6*a*, the clearance space 16 gradually narrows toward the outward direction. Thus, the material is able easily to enter the radially inward (with respect to the table) side of the clearance space because the space is widened at this side. As the material moves radially outward into the gradually narrowing clearance space, the material is effectively ground. On the radially outward side (with respect to the table) from the plane 22, the width of the clearance space 16** is substantially constant, thereby achieving final fine milling of the material.

The table **2*a* further includes an annular overhang 24 fixed to its upper surface adjacent the outer periphery of the groove 4*a*. The overhang 24 has a radially inner side 26, which overhangs the outer edge of the groove and throttles the outward side of the clearance space 16 to effectively resist the outward flow or escape of the material from the clearance space. This maintains or holds the material in the clearance 16** on the outward side for a relatively long time until it is sufficiently and finely milled.

Figure 3:
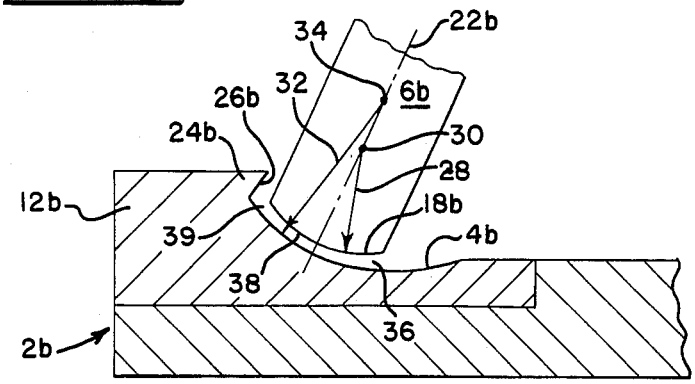

The second embodiment shown in FIG. 3 has a construction similar to FIG. 2. In FIG. 3, the roller **6*b* has a peripheral surface 18*b* which is substantially circular in cross section, the circle having a radius indicated by the arrow 28 and a center 30 of curvature. The center 30 is located in the axially central, radial plane 22*b* of the roller 6*b***.

The table liner **12*b* has an annular groove 4*b* formed in its upper surface. The groove 4*b* is substantially circular in cross section, the circle having a radius indicated by the arrow 32 and a center 34 of curvature. The center 34 is also located in the plane 22*b*, but is eccentric from the center 30** and is spaced toward the axis of the roller.

A first clearance space 36 is formed between the roller 6b and the groove 4b on the side of the plane 22b, which is radially inward with respect to the table 2b. The clearance space 36 narrows in the radially outward direction of the table 2b.

A second clearance space 38 is formed between the roller 6b and groove 4b on the radially outward side of the plane 22b, and it widens in the radially outward direction of the table 2b. The table liner 12b has an annular overhang 24b formed on its upper surface which overhangs the outer periphery of the groove 4b. The overhang 24b has a radially inner, conical side 26b, which overhangs the outer end of the second clearance 38 to effectively resist the outward flow or escape of the material therefrom.

This configuration thus forms a bulged or enlarged portion of the second clearance 38, which is throttled or narrowed in both directions. This bulged portion 39 retains a thick layer of the milled material, thereby improving the self-milling of the material so as to allow final milling.

Figure 4:
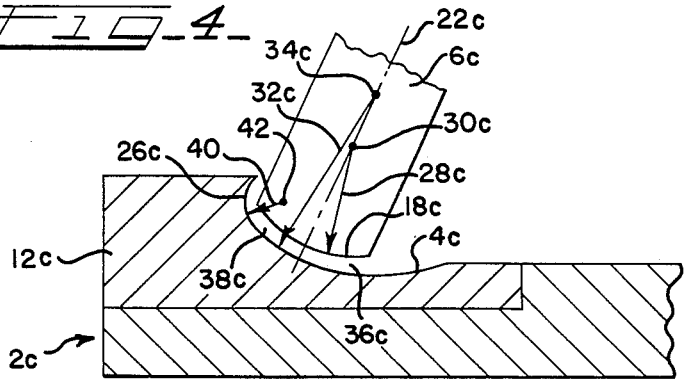

The third embodiment shown in FIG. 4 has a construction similar to FIG. 3. In FIG. 4, the roller 6c has a peripheral surface 18c which is circular in cross section, the circle having a radius 28c and a center 30c of curvature. The center 30c is located in the axially central, radial plane 22c of the roller.

The table liner 12c has an annular groove 4c formed in its upper surface. The major portion of the groove 4c is circular in cross section, the circle having a radius 32c and a center 34c of curvature, in its major region except the outer peripheral region. The center 34c is also located in the plane 22c, but it is eccentric from the center 30c and is spaced away from the groove 4c.

In the outer peripheral region, the groove 4c has a radius 40 and a center 42 of curvature in cross section. The radius 40 is smaller than the radius 28c of the roller 6c. The center 42 is located in the axially outer half of the roller. This forms a radially inner, annular surface 26c, which curves back toward the roller 6c and overhangs the outer clearance space 38c between the roller and groove 4c.

Figure 5:
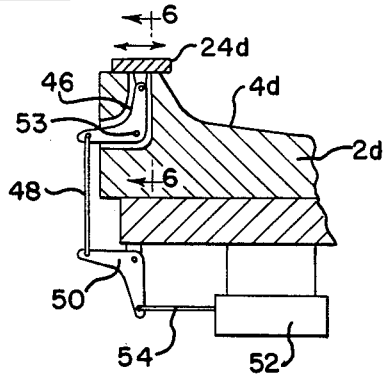
Figure 6:
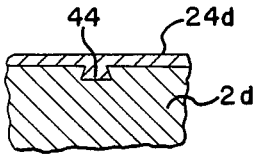
FIG. 6 is a cross-sectional view taken on the line VI—VI of FIG. 5.

In the fourth embodiment of FIGS. 5 and 6, the mill includes a rotary table 2d, which has an annular groove 4d formed in its upper surface. The table 2d carries a plurality of arcuate dams or overhangs 24d adjacent the outer periphery of the groove 4d. As shown in FIG. 6, each dam 24d is slidably mounted on the upper surface of the table 2d and it is radially slidably connected by a dovetail joint 44.

The dam 24d is connected to one arm of a bell crank 46 which is supported pivotally by a pin 53 on the table 2d. The other arm of the crank 46 is connected by a rod 48 to one arm of another bell crank 50, which is also supported on the table 2d. The other arm of this crank 50 is connected by a rod 54 to a hydraulic or electric drive 52, which is mounted to the table 2d. The drive 52 is operable, through the bell cranks, to radially move each dam 24d radially of the table so as to change the amount of the overhang of the groove 4d.

What is claimed is:

1. A roller mill for crushing material, comprising a table adapted to be rotatably driven on a substantially vertical axis, the table being adapted to receive the material in a central area adjacent said axis, said table having a substantially horizontal upper surface and an annular groove formed in said upper surface radially outwardly from said central area, said groove having a curved bottom surface, at least one roller having an axis of rotation which is above said upper surface and which angles downwardly and radially inwardly and substantially intersects said vertical axis, said roller having a bottom portion extending into said groove and having an outer peripheral surface which is curved in cross section, said mill when in use having said table and said roller rotated and the material extending into a clearance space formed between said peripheral surface and said bottom surface, said table having an annular overhang means on said upper surface adjacent the other periphery of said groove to throttle the radially outer portion of said clearance space, said overhang means extending radially inwardly and over said outer periphery of said groove and said bottom portion of said roller being closely adjacent said overhang means.

2. A roller mill according to claim 1, wherein said cleraance space includes an enlarged portion adjacent said overhang means.

3. A roller mill according to claim 1, wherein said overhang means is formed by an annular member fastened to said upper surface.

4. A roller mill according to claim 3, wherein said annular member is radially movable relative to said groove.

5. A roller mill according to claim 4, and further including means connected to said annular member for adjusting the position of said annular member.

6. A roller mill according to claim 1, wherein said clearance space includes a narrowest portion adjacent a radial plane of said roller which is axially central of said roller, and said clearance space widens away from said narrowest portion.

7. A roller mill according to claim 1, wherein said clearance space has a substantially constant width on the side adjacent said overhang means.

8. A roller mill according to claim 1, wherein said overhang means slants axially upwardly and radially inwardly over said outer periphery.

* * * * *